US008118301B2

(12) United States Patent
Fujii et al.

(10) Patent No.: US 8,118,301 B2
(45) Date of Patent: Feb. 21, 2012

(54) SHEET DISCHARGING DEVICE AND IMAGE FORMING APPARATUS INCLUDING SAME

(75) Inventors: Ikuo Fujii, Kawasaki (JP); Yasuo Matsuyama, Itami (JP); Ippei Kimura, Ikeda (JP)

(73) Assignee: Ricoh Company, Limited, Toyko (JP)

( * ) Notice: Subject to any disclaimer, the term of this patent is extended or adjusted under 35 U.S.C. 154(b) by 0 days.

(21) Appl. No.: 12/802,000

(22) Filed: Jul. 7, 2010

(65) Prior Publication Data

US 2011/0024966 A1 Feb. 3, 2011

(30) Foreign Application Priority Data

Jul. 28, 2009 (JP) ..... 2009-175032
Jan. 29, 2010 (JP) ..... 2010-018271

(51) Int. Cl.
*B65H 31/00* (2006.01)

(52) U.S. Cl. ..... 271/207; 271/213; 271/314

(58) Field of Classification Search ..... 271/213, 271/314, 207, 81; 399/405
See application file for complete search history.

(56) References Cited

U.S. PATENT DOCUMENTS 5,082,269 A * 1/1992 Hirayama et al. ..... 271/65
2008/0054554 A1 3/2008 Nishii et al.
2011/0097126 A1* 4/2011 Kimura et al. ..... 399/405

FOREIGN PATENT DOCUMENTS

JP S58-004099 1/1983
JP 11-286363 10/1999

* cited by examiner

*Primary Examiner* — Jeremy R Severson
(74) *Attorney, Agent, or Firm* — Harness, Dickey & Pierce, P.L.C.

(57) ABSTRACT

A sheet discharging device including a sheet discharging unit provided at one end of an image forming apparatus; a sheet discharge tray located adjacent to the sheet discharging unit, rotatably provided at the end of the image forming apparatus in a stored position to cover the end of the image forming apparatus and in an extended position extended from the end of the image forming apparatus to stack sheets discharged from the image forming apparatus; and a driving mechanism to drive a shutter provided to the sheet discharge tray in conjunction with rotary movement of the sheet discharge tray to open an opening in the sheet discharge tray in the stored position and to close the opening in the sheet discharge tray in the extended position.

19 Claims, 10 Drawing Sheets

SHEET DISCHARGING DEVICE AND IMAGE FORMING APPARATUS INCLUDING SAME

PRIORITY STATEMENT

The present patent application claims priority from Japanese Patent Application Nos. 2009-175032, filed on Jul. 28, 2009, and 2010-018271, filed on Jan. 29, 2010, both in the Japan Patent Office, each of which is hereby incorporated herein by reference in its entirety.

BACKGROUND

1. Technical Field

Illustrative embodiments described in this patent specification generally relate to a sheet discharging device and an image forming apparatus, and more particularly to a sheet discharging device including a sheet discharging unit that discharges sheets and a sheet discharge tray that stacks the sheets discharged by the sheet discharging unit, and an image forming apparatus including the sheet discharging device.

2. Description of the Related Art

Related-art image forming apparatuses, such as copiers, printers, facsimile machines, and multifunction devices having two or more of copying, printing, and facsimile functions, typically form a toner image on a recording medium (e.g., a sheet of paper, etc.) according to image data using an electrophotographic method. In such a method, for example, a charger charges a surface of an image carrier (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet; and a fixing device applies heat and pressure to the sheet bearing the toner image to fix the toner image onto the sheet. The sheet bearing the fixed toner image is then discharged from the image forming apparatus.

Increasing demand for smaller installation space has required greater compactness of image forming apparatuses. FIG. 1 is a vertical cross-sectional view illustrating a configuration of an image forming apparatus 110 of the related art. The image forming apparatus 110 includes a sheet feed tray 101 storing recording media such as sheets of paper, a sheet feed roller 102 provided downstream from the sheet feed tray 101 in a direction of conveyance of the sheet, a pair of conveyance rollers 103 provided downstream from the sheet feed roller 102 in the direction of conveyance of the sheet, image forming units 104Y, 104M, 104C, and 104K (hereinafter collectively referred to as image forming units 104) each forming a toner image of a specific color, that is, yellow, magenta, cyan, or black, on the sheet, conveyance belt 105 provided below the image forming units 104, an irradiating device 106 that irradiates photoconductors included in the image forming units 104, a fixing device 107 that fixes the toner image onto the sheet using heat, a sheet discharge tray 108 onto which the sheet having the fixed image thereon is discharged from the image forming apparatus 110, a pair of discharging rollers 109 that conveys the sheet having the fixed image thereon to the sheet discharge tray 108, and so forth. A sheet stored on the sheet feed tray 101 is fed forward by the sheet feed roller 102 and is conveyed to the conveyance belt 105 through the pair of conveyance rollers 103. While the sheet is being conveyed by the conveyance belt 105, toner images formed on the photoconductors included in the image forming units 104 are sequentially transferred onto the sheet and superimposed one atop the other so that a full-color toner image is formed on the sheet. The sheet having the full-color toner image thereon is then conveyed to the fixing device 107 to fix the full-color toner image onto the sheet with heat and pressure. Thereafter, the sheet having a fixed full-color image thereon is discharged from the image forming apparatus 110 through a discharging opening by the pair of discharging rollers 109 and is stacked on the sheet discharge tray 108.

The sheet discharge tray 108 is hinged along one edge and attached to the image forming apparatus 110. Accordingly, the sheet discharge tray 108 is opened to an extended position as illustrated by broken lines in FIG. 1 to stack the sheet discharged from the image forming apparatus 110. By contrast, with the sheet discharge tray 108 in a closed position as illustrated by solid lines in FIG. 1 the sheet discharge tray 108 is flush with the exterior of the image forming apparatus 110. In those image forming apparatuses in which a conveyance path of a sheet is almost straight from a sheet feed tray to a sheet discharge tray such as the image forming apparatus 110, the sheet discharge tray is usually provided on either front or back side surfaces of the image forming apparatuses. For example, the image forming apparatus 110 shown in FIG. 1 has the sheet discharge tray 108 provided on a front surface thereof. Consequently, an installation space required for the image forming apparatus 110 is increased to the front by the length of the sheet discharge tray 108.

In addition, the sheet discharge tray 108 must have a size sufficient for stacking the sheet, which in turn increases the space required for the sheet discharge tray 108. In order to reduce the space for the sheet discharge tray 108, an opening may be provided at a portion of the sheet discharge tray 108 facing a main body of the image forming apparatus 110, and the sheet is discharged from the image forming apparatus 110 through the opening and into the sheet discharge tray 108 while the sheet discharge tray 108 is closed. Such a configuration allows a user to use the image forming apparatus 110 without having to open the sheet discharge tray, thereby reducing the installation space for the image forming apparatus 110.

The above-described arrangement can work well in a case in which images are formed on only several sheets of paper, because the sheet discharge tray 108 does not need to be opened. The sheets discharged from the image forming apparatus 110 through the opening may be manually received by the user and directly stacked on a desk positioned next to the image forming apparatus 110, or the like.

One example of a related-art image forming apparatus includes a sheet discharge tray having an opening or a cutout therein with a width greater than the maximum width of a sheet of paper used in the image forming apparatus. The sheet discharge tray is rotatably provided near a discharging opening of the image forming apparatus from where the sheet is discharged to stack the sheet thus discharged. The opening or the cutout is positioned outside a conveyance path of the sheet discharged from the discharging opening of the image forming apparatus when the sheet discharge tray is in a first position protruding from the image forming apparatus to stack the sheet discharged from the image forming apparatus. By contrast, the opening or the cutout is positioned corresponding to the discharging opening when the sheet discharge tray is in a second position folded toward the image forming apparatus.

However, a problem with the above-described arrangement is that the sheet stacked on the sheet discharge tray in the first position may drop through the opening or the cutout. Further, a leading edge of the sheet discharged from the image forming apparatus may get stuck or jammed in the opening.

In another approach, to reduce the space required for the apparatus the sheet discharge tray is fixedly mounted at an angle to a substantially straight conveyance path of the sheets. The sheet discharge tray has an opening that can be covered or closed by a plate. The opening lies on a virtual line representing an extension of the conveyance path of the sheets. The sheets are discharged through the opening.

However, because the above-described sheet discharge tray is not rotatable but is fixed at an angle to the image forming apparatus, this configuration is not applicable to a sheet discharge tray having a shutter that is openably closed in conjunction with rotation or opening and closing of the sheet discharge tray.

SUMMARY

In view of the foregoing, illustrative embodiments described herein provide a sheet discharging device including a sheet discharge tray having an opening and a shutter disposed over the opening that opens and closes the opening. The opening does not prevent discharge of sheets to the sheet discharge tray in an extended or opened position, so that the sheets thus discharged are reliably stacked on the sheet discharge tray. Illustrative embodiments described herein also provide an image forming apparatus including the sheet discharging device.

At least one embodiment provides a sheet discharging device including a sheet discharging unit provided at one end of an image forming apparatus; a sheet discharge tray located adjacent to the sheet discharging unit, and a driving mechanism. The sheet discharging unit includes a pair of discharging rollers to discharge sheets from the image forming apparatus. The sheet discharge tray is rotatably provided at the end of the image forming apparatus in a stored position to cover the end of the image forming apparatus and in an extended position extended from the end of the image forming apparatus to stack the sheets discharged from the image forming apparatus. The sheet discharge tray includes an opening through which the sheets are discharged from the image forming apparatus. The opening is provided at a portion of the sheet discharge tray opposite the pair of discharging rollers. The sheet discharge tray further includes a shutter disposed over the opening to open and close the opening. The driving mechanism drives the shutter in conjunction with rotary movement of the sheet discharge tray to open the opening in the sheet discharge tray in the stored position and to close the opening in the sheet discharge tray in the extended position.

At least one embodiment provides an image forming apparatus including the sheet discharging device as described above and an image forming unit to form images on sheets based on image data.

Additional features and advantages of the illustrative embodiments will be more fully apparent from the following detailed description, the accompanying drawings, and the associated claims.

BRIEF DESCRIPTION OF THE DRAWINGS

A more complete appreciation of the illustrative embodiments described herein and the many attendant advantages thereof will be readily obtained as the same becomes better understood by reference to the following detailed description when considered in connection with the accompanying drawings, wherein.

Figure 1:
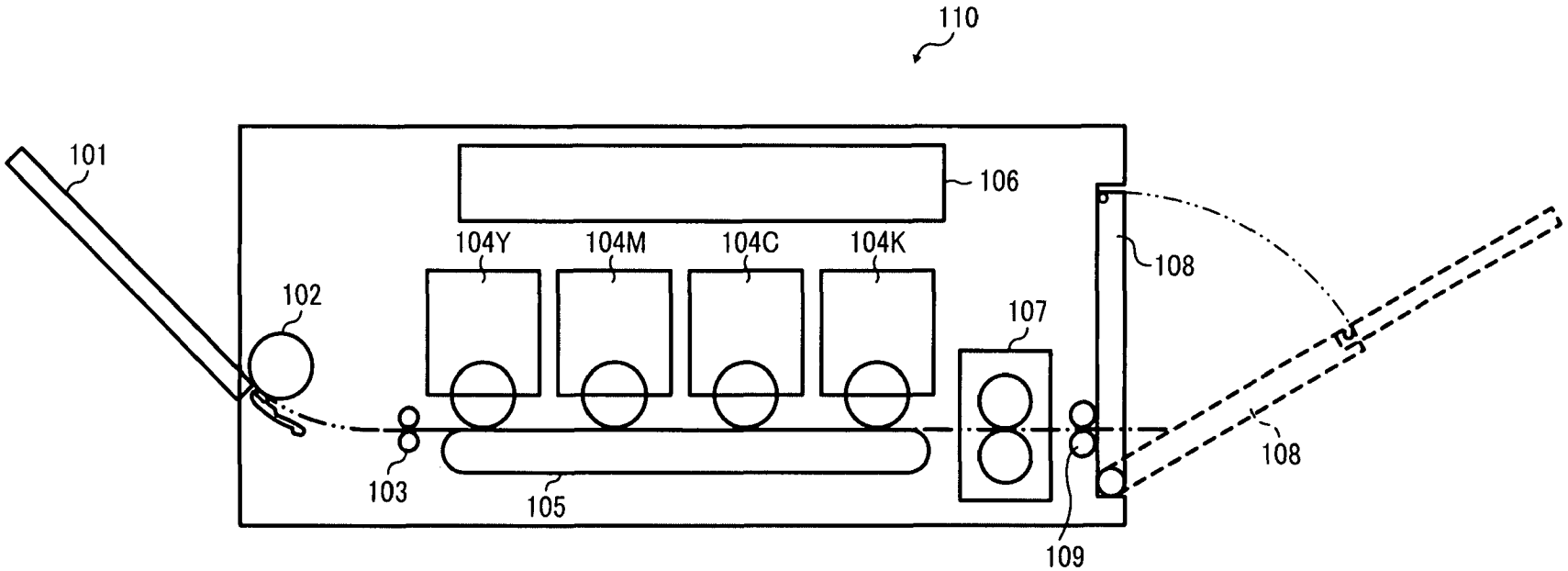
FIG. 1 RELATED ART
FIG. 1 is a vertical cross-sectional view illustrating a configuration of a related-art image forming apparatus.

The accompanying drawings are intended to depict illustrative embodiments and should not be interpreted to limit the scope thereof. The accompanying drawings are not to be considered as drawn to scale unless explicitly noted.

DETAILED DESCRIPTION OF ILLUSTRATIVE EMBODIMENTS

In describing illustrative embodiments illustrated in the drawings, specific terminology is employed for the sake of clarity. However, the disclosure of this specification is not intended to be limited to the specific terminology so selected, and it is to be understood that each specific element includes all technical equivalents that operate in a similar manner and achieve a similar result.

A description is now given of illustrative embodiments of the present invention with reference to drawings, wherein like reference numerals designate identical or corresponding parts throughout the several views.

Figure 2:
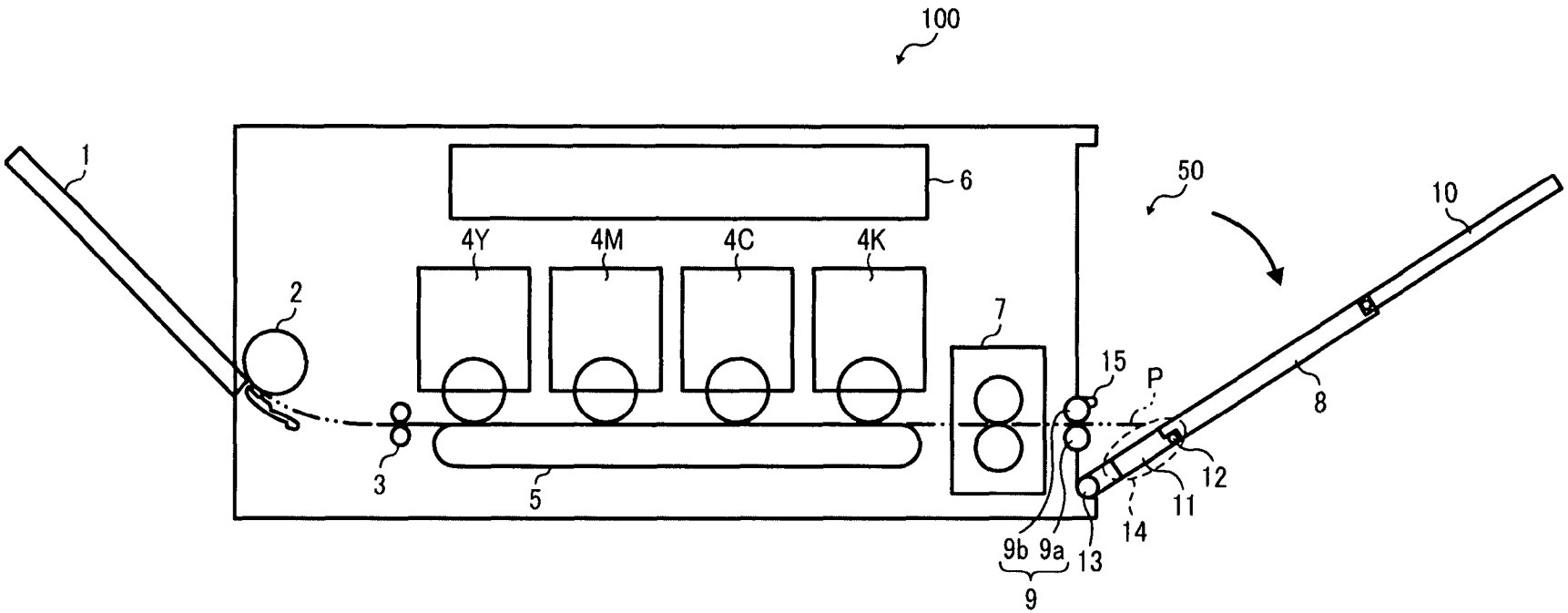
FIG. 2 is a vertical cross-sectional view illustrating a configuration of an image forming apparatus according to illustrative embodiments.

FIG. 2 is a vertical cross-sectional view illustrating a configuration of an image forming apparatus 100 according to illustrative embodiments. The image forming apparatus 100 according to illustrative embodiments has the same configuration as the related-art image forming apparatus 110 described previously, except for a configuration of a sheet discharging device included therein.

Specifically, the image forming apparatus 100 includes a sheet feed tray 1 that stores recording media such as sheets of paper, a sheet feed roller 2 provided downstream from the sheet feed tray 1 in a direction of conveyance of the sheet, a pair of conveyance rollers 3 provided downstream from the sheet feed roller 2 in the direction of conveyance of the sheet, image forming units 4Y, 4M, 4C, and 4K (hereinafter collectively referred to as image forming units 4) each forming a toner image of a specific color, that is, yellow, magenta, cyan, or black, on the sheet, a conveyance belt 5 provided below the image forming units 4, an irradiating device 6 that irradiates photoconductors included in the image forming units 4, a fixing device 7 that fixes the toner image onto the sheet using heat, a sheet discharging device 50, and so forth. The sheet stored on the sheet feed tray 1 is fed by the sheet feed roller 2, and is conveyed to the conveyance belt 5 through the pair of conveyance rollers 3. While the sheet is being conveyed by the conveyance belt 5, the toner images formed on the photoconductors included in the image forming units 4 are sequentially transferred onto the sheet and superimposed one atop the other so that a full-color toner image is formed on the sheet. The sheet having the full-color toner image thereon is then conveyed to the fixing device 7 to fix the full-color toner image onto the sheet with heat and pressure. Thereafter, the sheet having a fixed full-color image thereon is discharged from the image forming apparatus 100 through a discharging opening by a pair of discharging rollers 9*a* and 9*b* (hereinafter collectively referred to as a pair of discharging rollers 9) included in the sheet discharging device 50.

Figure 3:
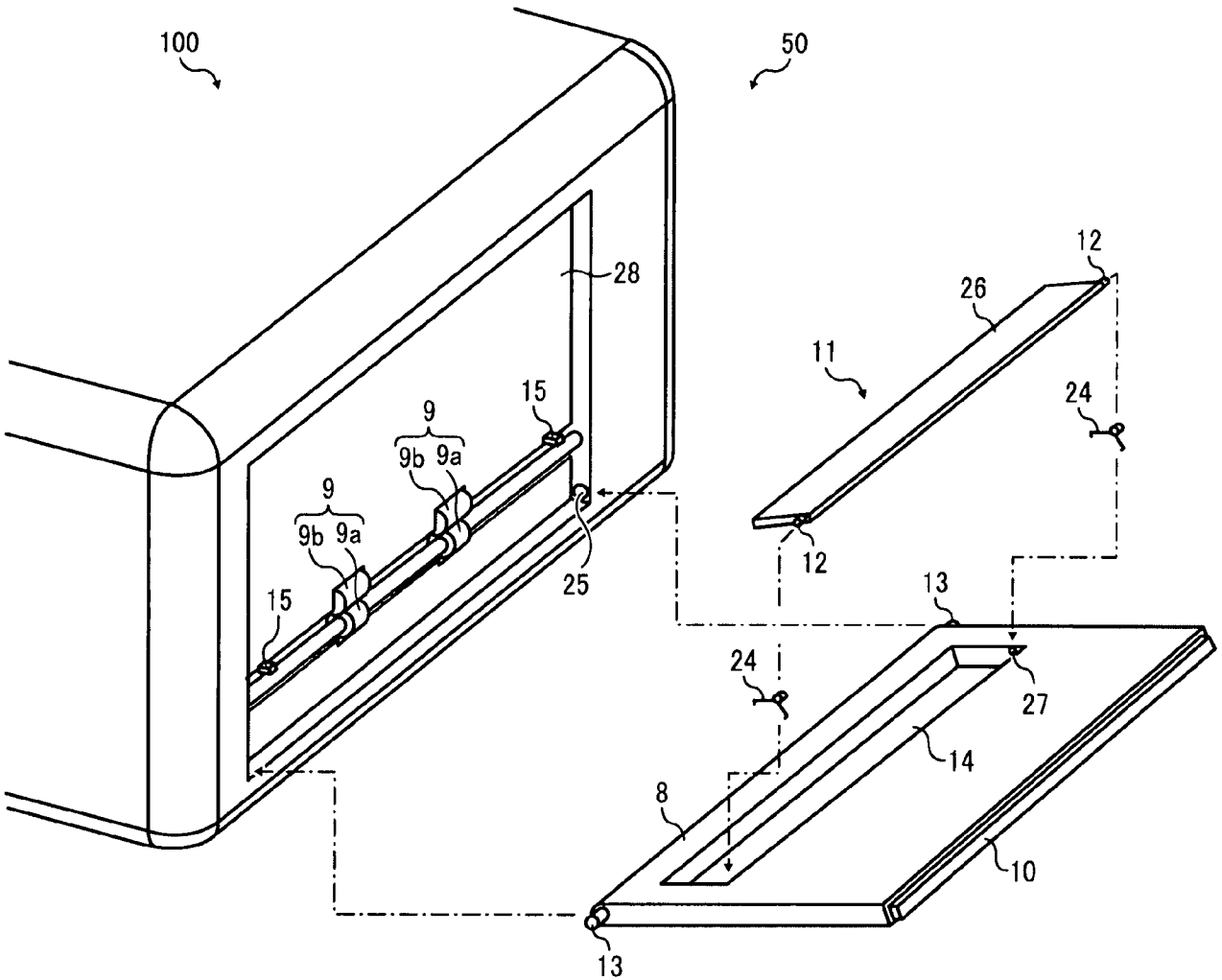
FIG. 3 is a perspective view illustrating a configuration of a sheet discharging device according to a first illustrative embodiment.
Figure 4B:
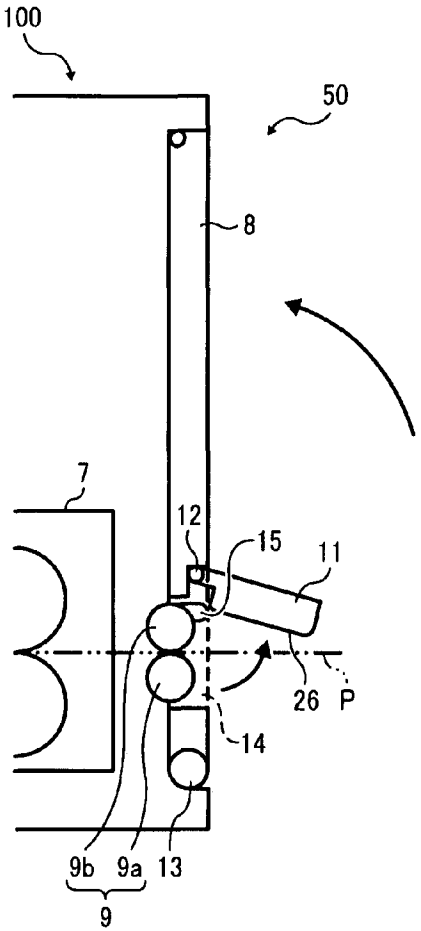
FIGS. 4A and 4B are vertical cross-sectional views respectively illustrating opened/closed states of a sheet discharge tray according to the first illustrative embodiment.
Figure 4A:
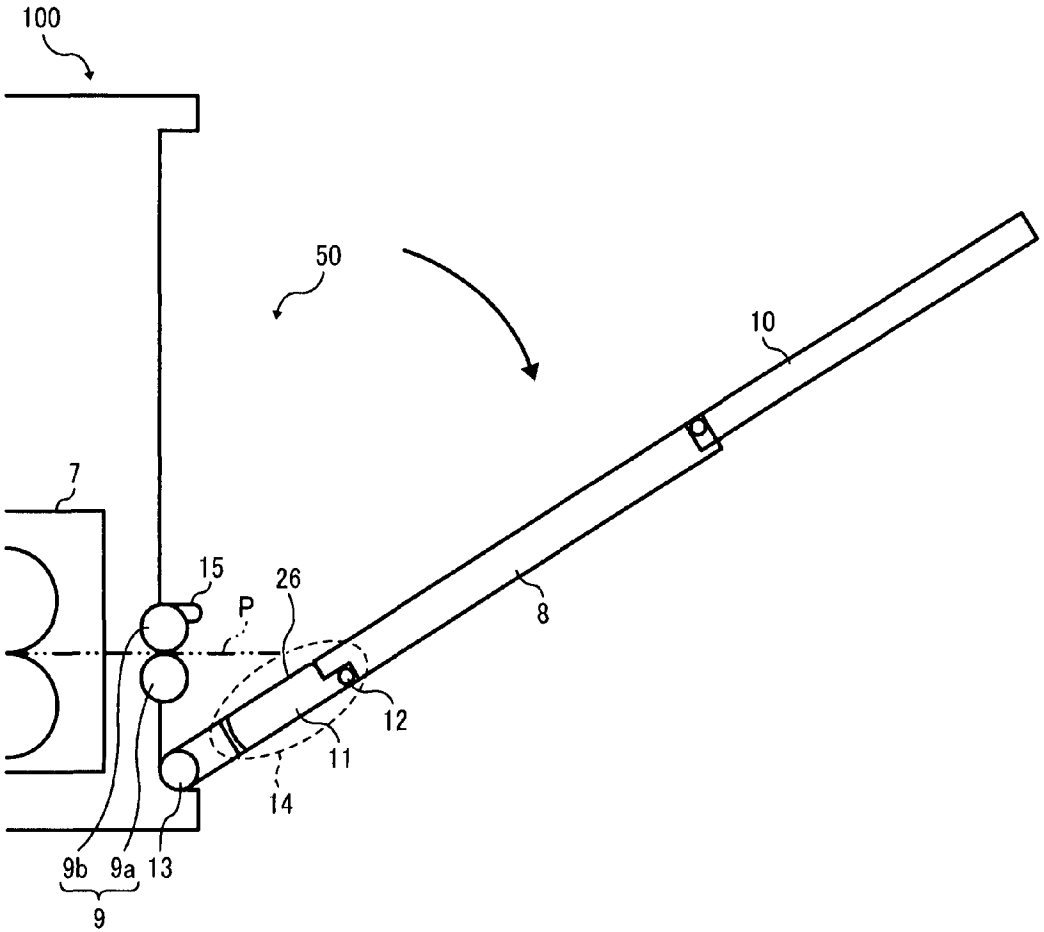
Figure 5:
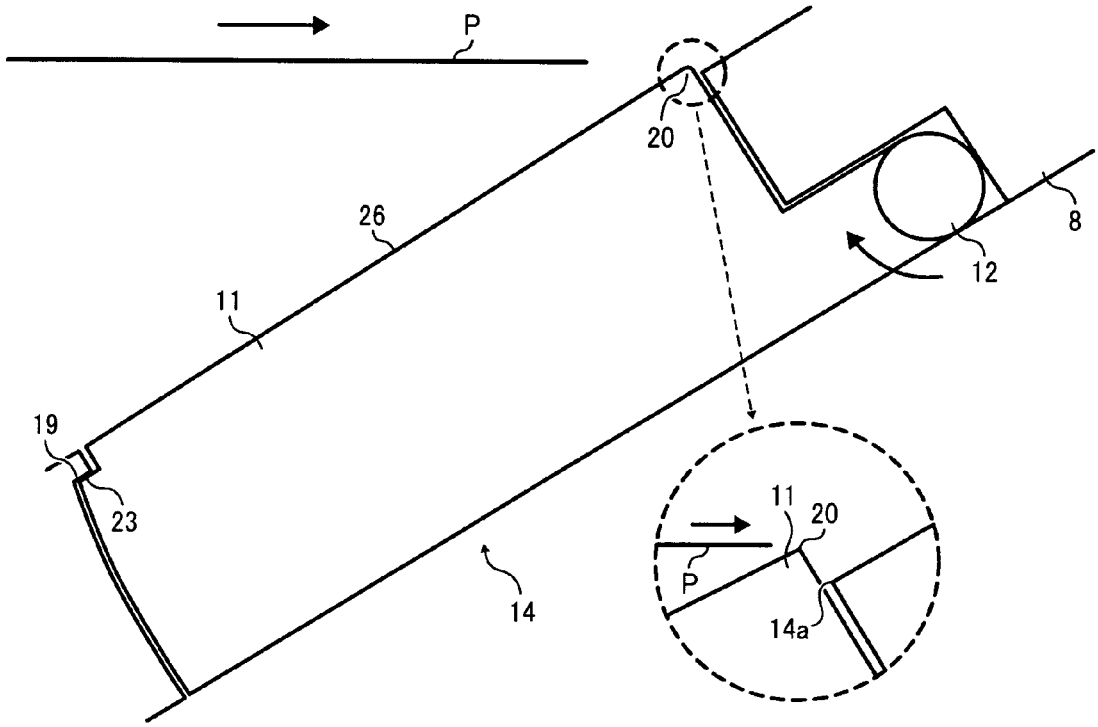
FIG. 5 is an enlarged view illustrating a part of the sheet discharge tray illustrated in FIG. 4A.

A description is now given of the sheet discharging device 50 according to a first illustrative embodiment. FIG. 3 is a perspective view illustrating a configuration of the sheet discharging device 50 according to the first illustrative embodiment. FIG. 4A is a vertical cross-sectional view illustrating a sheet discharge tray 8 in an opened state, and FIG. 4B is a vertical cross-sectional view illustrating the sheet discharge tray 8 in a closed state. FIG. 5 is an enlarged view illustrating a part of the sheet discharge tray 8 in the opened state, circled by a broken line in FIG. 4A.

Cylindrical protrusions 13 functioning as hinges and respectively provided at both ends of the sheet discharge tray 8 in the long direction thereof engage holes 25 respectively provided in the body of the image forming apparatus 100, so that the sheet discharge tray 8 is rotatably supported by the image forming apparatus 100 and movable between an open position at an angle to the image forming apparatus 100 and a closed position substantially flush with the surface of the image forming apparatus 100. The pair of discharging rollers 9 serving as a sheet discharging unit that discharges a sheet P having a fixed full-color image thereon from the image forming apparatus 100 is provided at the discharging opening of the image forming apparatus 100. The cylindrical protrusions 13 of the sheet discharge tray 8 are positioned below the pair of discharging rollers 9. A sheet P discharged from the image forming apparatus 100 while the sheet discharge tray 8 is opened is stacked on the sheet discharge tray 8.

The sheet discharge tray 8 includes an extendable auxiliary tray 10 therein. The auxiliary tray 10 is extended from the sheet discharge tray 8 to extend the sheet discharge tray 8 depending on a length of the sheet P. The sheet discharge tray 8 further includes an opening 14 at a lower portion therein, opposite the pair of discharging rollers 9. The opening 14 is wider than the maximum width of the sheet P that can be conveyed by the image forming apparatus 100, such that the sheet P discharged from the image forming apparatus 100 when the sheet discharge tray 8 is closed does not collide with the sheet discharge tray 8. More specifically, the opening 14 is sized to accommodate the pair of discharging rollers 9 therewithin. Accordingly, when the sheet discharge tray 8 is closed, the pair of discharging rollers 9 is fitted into the opening 14. As a result, a size of the image forming apparatus 100 in a direction of discharge of the sheet P when the sheet discharge tray 8 is closed can be reduced by the size of the pair of discharging rollers 9 compared to the related-art image forming apparatus 110 described previously.

The sheet discharge tray 8 is provided with a hinged shutter 11 over the opening 14, and the shutter 11 is rotatably supported by protrusions 12 that engage holes 27 respectively provided in the sheet discharge tray 8 along opposite sides of the opening 14. The shutter 11 moves with the sheet discharge tray 8, that is, between an extended position (or the opened state) as illustrated in FIG. 4A and a stored position (or the closed state) as illustrated in FIG. 4B. Accordingly, the shutter 11 is automatically opened and closed without requiring operation by a user.

The shutter 11 is constantly biased by a pair of torsion springs 24 respectively provided to the protrusions 12 toward a direction of closing the opening 14. Accordingly, when the sheet discharge tray 8 is opened, the opening 14 is closed by the shutter 11 and is flush with the surface of the sheet discharge tray 8 as illustrated in FIG. 4A, so that a sheet P discharged from the image forming apparatus 100 can be reliably stacked on the sheet discharge tray 8. As illustrated in FIG. 5, the shutter 11 has a chamfered edge 23 opposite its hinged edge, such that the shutter 11, biased by the torsion springs 24, contacts a protruding lip or contact portion 19 along a lower upstream edge of the opening 14 to appropriately position the shutter 11.

In addition, when the shutter 11 closes the opening 14 to form a flush surface with the sheet discharge tray 8, an upper downstream edge 20 of the shutter 11 opposite the chamfered edge 23 in the direction of discharge of the sheet P rests above an upper downstream edge 14*a* of the opening 14 to which the sheet P is conveyed from the upper downstream edge 20, forming a slight step thereat. This downward step enables a leading edge of the sheet P discharged from the image forming apparatus 100 to avoid getting stuck between the upper downstream edge 20 of the shutter 11 and the upper downstream edge 14*a* of the opening 14 in the sheet discharge tray 8.

A description is now given of a driving mechanism that drives the shutter 11 in conjunction with opening and closing of the sheet discharge tray 8.

As illustrated in FIGS. 3, 4A and 4B, a pair of protrusions 15 each serving as the driving mechanism are provided near the pair of discharging rollers 9. While the sheet discharge tray 8 is being moved to the closed position, the protrusions 15 contact a surface 26 of the shutter 11 to push the shutter 11 against the direction in which the shutter 11 is biased by the torsion springs 24 to open the shutter 11 and thus open the opening 14 as illustrated in FIG. 4B. In the present embodiment, the protrusions 15 contact the shutter 11 at positions near the protrusions 12 of the shutter 11 to swing the shutter 11 out of the way of the opening 14. The protrusions 15 and a cover 28 that is a component of the image forming apparatus 100 and which faces the sheet discharge tray 8 when the sheet discharge tray 8 is in the closed state may be formed together as a single integrated unit, thereby reducing a number of components. Alternatively, the protrusions 15 and a holding guide, not shown, for the pair of discharging rollers 9 may be formed together as a single integrated unit to accomplish the same end.

The two protrusions 15 are provided in a width direction of the image forming apparatus 100 so that the shutter 11 is reliably driven. In the first illustrative embodiment, the two protrusions 15 are provided at positions to contact right and left ends of the shutter 11, thereby reliably driving the shutter 11.

Figure 6B:
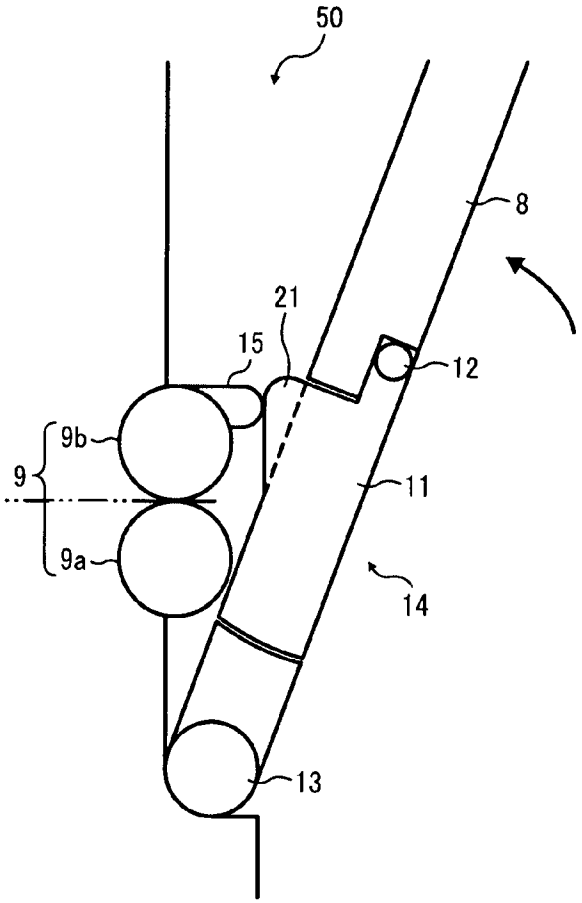
FIGS. 6A and 6B are enlarged views respectively illustrating unpreferred and preferred examples of the configuration of the sheet discharging device according to the first illustrative embodiment.
Figure 6A:
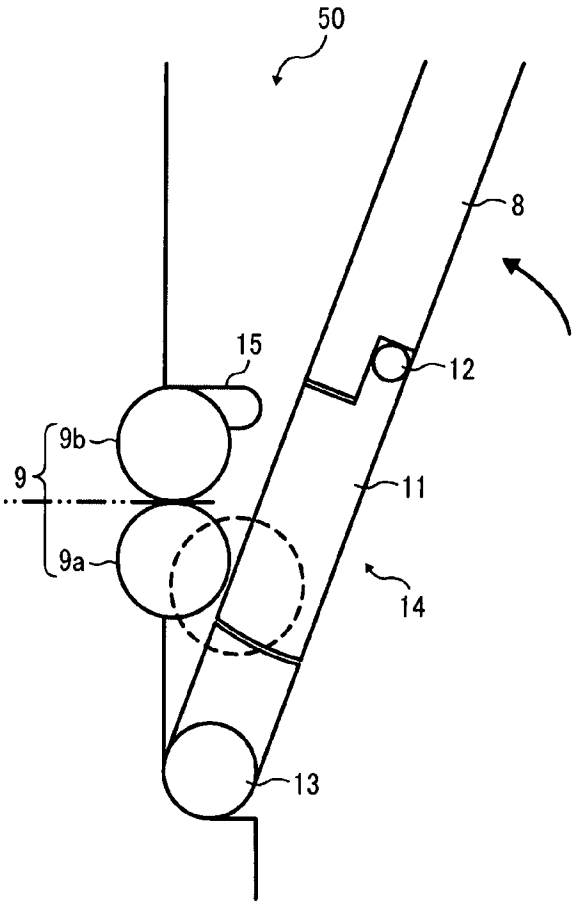

The shutter 11 has convexities 21 that contact the protrusions 15. FIGS. 6A and 6B are enlarged view respectively illustrating unpreferred and preferred examples of the configuration of the sheet discharging device 50. Specifically, FIG. 6A shows an unpreferred example of the configuration of the sheet discharging device 50, and FIG. 6B shows the configuration of the sheet discharging device 50 according to the first illustrative embodiment. When the protrusions 12 of the shutter 11 are positioned at an upper downstream portion of the opening 14 as illustrated in FIG. 6A, the protrusions 15 must protrude farther than the discharging roller 9*a* in order to prevent the shutter 11 from first contacting the discharging roller 9*a* when the sheet discharge tray 8 is closed. Otherwise, a surface of the discharging roller 9*a* that conveys the sheet P may be damaged by the shutter 11. However, the protrusions 15 having a length too long may be also easily damaged by the shutter 11. To solve such problems, the shutter 11 has the convexities 21 at positions contacting the protrusions 15 so that the protrusions 15 contact the convexities 21 to open the shutter 11 before the discharging roller 9*a* contacts the shutter 11 as illustrated in FIG. 6B. In order to prevent the convexities 21 from being an obstacle to discharge of the sheet P, it is preferable that the convexities 21 and the protrusions 15 be provided outside the width of the sheet P and be prevented from contacting the sheet P.

Although the protrusions 12 of the shutter 11 are provided at the upper downstream portion of the opening 14 as described above in the first illustrative embodiment, the configuration of the sheet discharging device 50 is not limited thereto. For example, the protrusions 12 of the shutter 11 may be provided at a lower upstream portion of the opening 14 as illustrated in FIG. 7A. FIG. 7A is a vertical cross-sectional view illustrating a configuration of the sheet discharging device 50 according to a second illustrative embodiment. Provision of the protrusions 12 at the lower upstream portion of the opening 14 can move the shutter 11 in conjunction with opening and closing of the sheet discharge tray 8 in the same manner as the first illustrative embodiment, the only difference being the edge along which the shutter 11 is hinged and about which it swings relative to the image forming apparatus 100.

Specifically, in the configuration illustrated in FIG. 7A, the protrusions 12 of the shutter 11 are provided at lower upstream portions of the sheet discharge tray 8 on the inner walls of the opening 14, and the shutter 11 also serves as an auxiliary tray for supporting the sheet P discharged from the image forming apparatus 100.

However the configuration according to the first illustrative embodiment illustrated in FIGS. 4A and 4B is preferable to that described above, because in the configuration according to the first illustrative embodiment, the pair of discharging rollers 9 is covered from the top thereof with the shutter 11, whereas in the second embodiment the pair of discharging rollers 9 and number of components provided in a discharge opening of the image forming apparatus 100 are exposed from above.

Figure 7B:
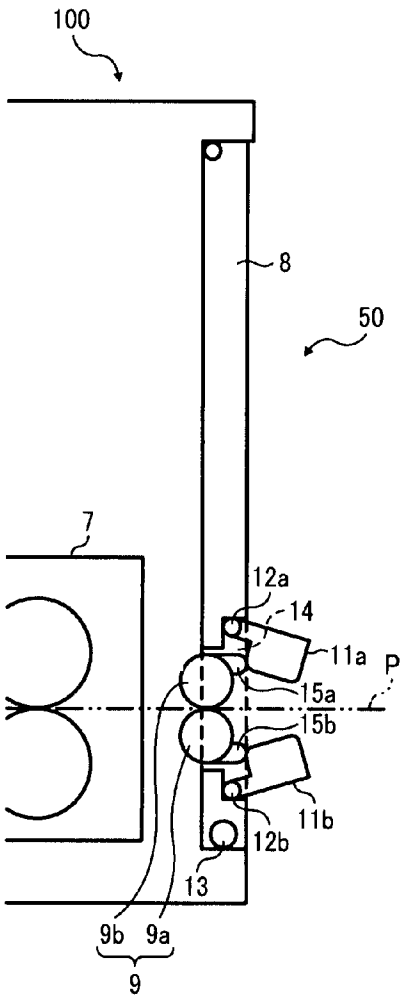
FIG. 7B is a vertical cross-sectional view illustrating a configuration of a sheet discharging device according to a third illustrative embodiment.
Figure 7A:
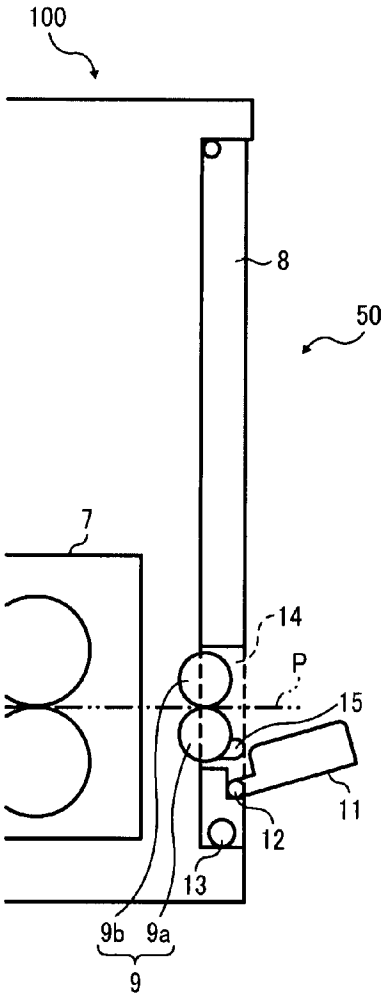
FIG. 7A is a vertical cross-sectional view illustrating a configuration of a sheet discharging device according to a second illustrative embodiment.

Alternatively, although incurring more costs compared to the first and second illustrative embodiments, the shutter 11 may be hinged at both upper and lower edges and configured to include an upper flap 11*a* and a lower flap 11*b* as illustrated in FIG. 7B. FIG. 7B is a vertical cross-sectional view illustrating a configuration of the sheet discharging device 50 according to a third illustrative embodiment.

In the configuration according to the third illustrative embodiment, protrusions 12*a* and 12*b* of the upper and lower flaps 11*a* and 11*b* are rotatably provided respectively at the upper and lower portions of the sheet discharge tray 8 along the inner walls of the opening 14. Further, upper protrusions 15*a* and lower protrusions 15*b* are provided to drive the upper and lower flaps 11*a* and 11*b*, respectively. Accordingly, both advantages provided by the first and second illustrative embodiments can be obtained in the third illustrative embodiment.

A description is now given of a rotatable range of the shutter 11.

Figure 8:
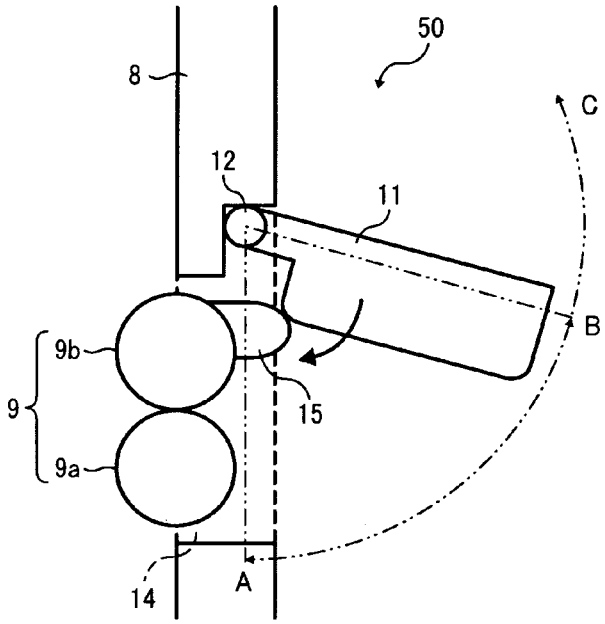
FIG. 8 is a vertical cross-sectional view illustrating an example of operation of a shutter.

FIG. 8 is a vertical cross-sectional view illustrating operation of the shutter 11 of the sheet discharging device 50 according to the first illustrative embodiment. The shutter 11 is rotatable at least between a position A to close the opening 14 and a position B by being pushed away by the protrusions 15. The shutter 11 is rotatable to a position beyond a virtual line representing an extension of the sheet P discharged from the image forming apparatus 100, thereby being prevented from contacting the sheet P.

It is known that, in an image forming apparatus employing an electrophotographic method such as the image forming apparatus 100, the sheet P tends to be curled by heat applied by the fixing device 7. When the sheet P discharged from the image forming apparatus 100 is considerably curled toward the shutter 11, the sheet P may contact the shutter 11 even when the shutter 11 is positioned at the position B, causing scratches at the leading edge of the sheet P or on an image on the sheet P.

To solve this problem, the shutter 11 is rotatable further above the position B, that is, to a position C in FIG. 8, upon contact with the sheet P. That is, the shutter 11 is pushed by the sheet P and is swung to the position C, thereby reducing damage to the leading edge of the sheet P. It is to be noted that contact of the curled portion of the sheet P with the shutter 11 flattens the curled portion of the sheet P.

A description is now given of a configuration of the sheet discharging device 50 that prevents damage to the sheet P.

Figure 9:
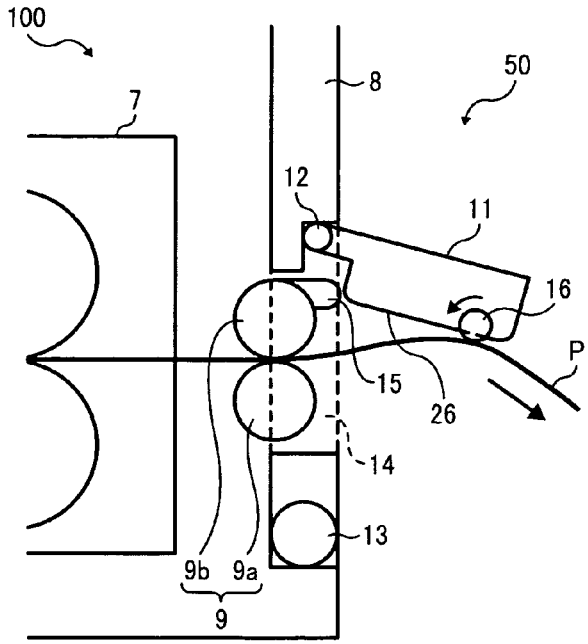
FIG. 9 is a vertical cross-sectional view illustrating a configuration of a sheet discharging device according to a fourth illustrative embodiment.

FIG. 9 is a vertical cross-sectional view illustrating a configuration of the sheet discharging device 50 according to a fourth illustrative embodiment. In the fourth illustrative embodiment, a driven roller 16 is provided on the surface 26 of the shutter 11. The driven roller 16 may be formed of an elastic material such as resin or rubber. It is preferable that the surface of the driven roller 16 be made of a soft material such as sponge or a material with a low surface frictional resistance in order to reduce damage to an image formed on the sheet P.

Figure 10:
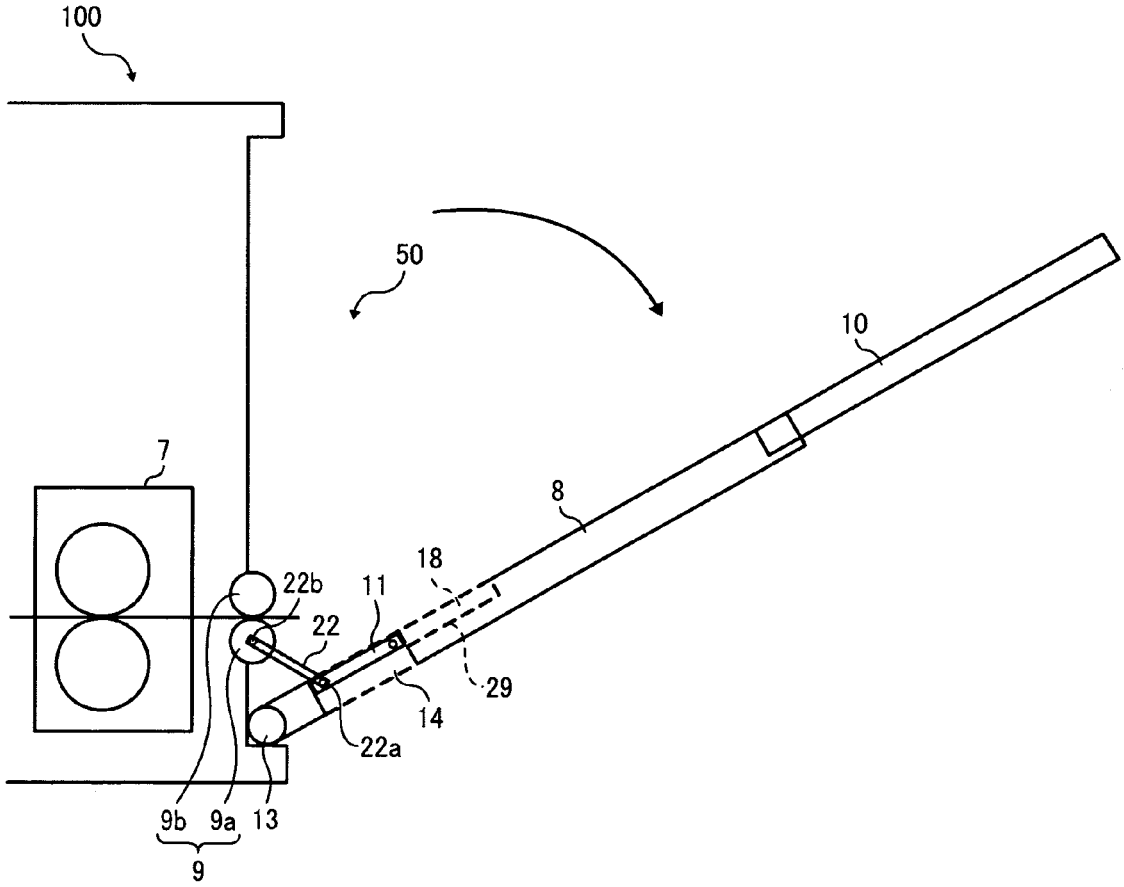
FIG. 10 is a vertical cross-sectional view illustrating a configuration of a sheet discharging device according to a fifth illustrative embodiment.
Figure 11A:
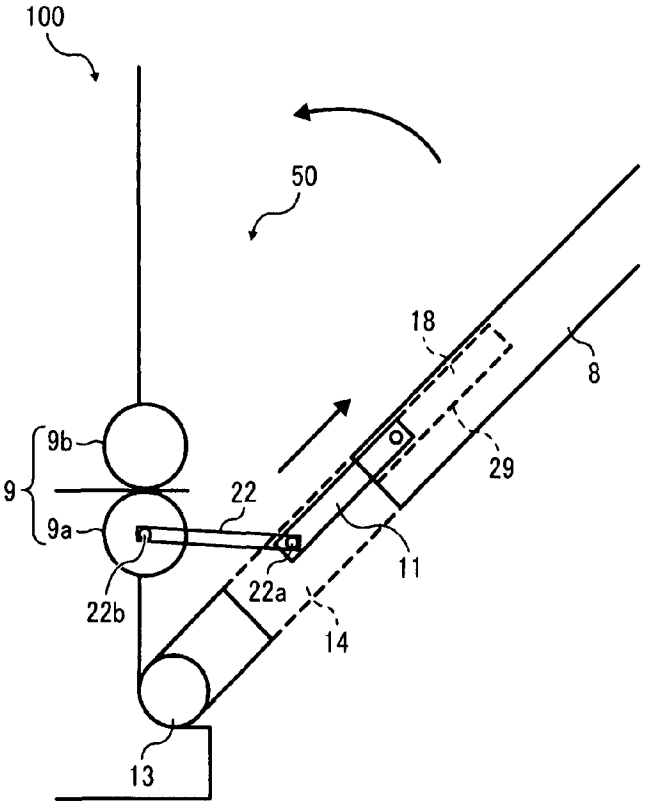
FIGS. 11A to 11C are vertical cross-sectional views respectively illustrating operations of the sheet discharging device illustrated in FIG. 10.
Figure 11B:
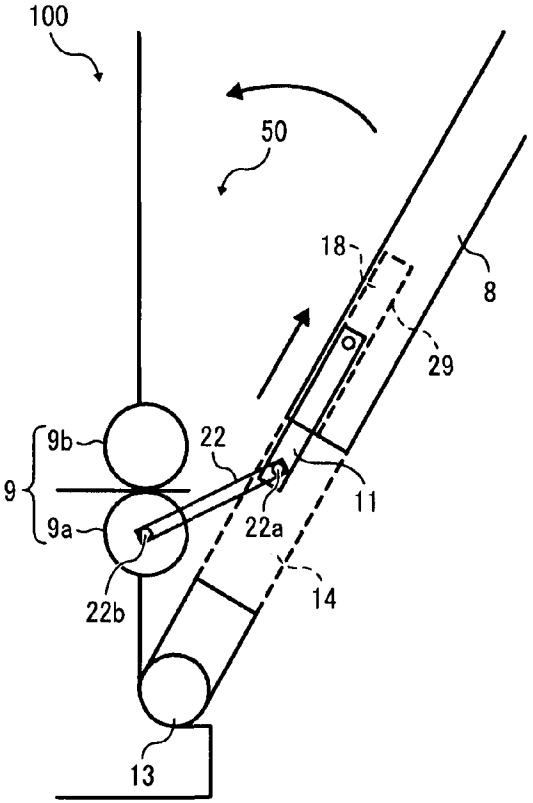
Figure 11C:
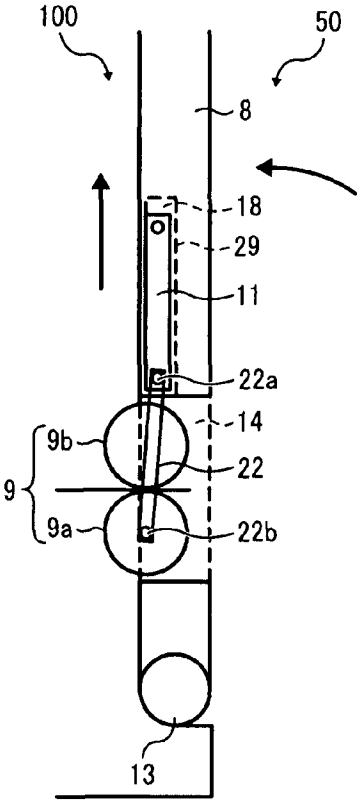

A description is now given of the sheet discharging device 50 according to a fifth illustrative embodiment. FIG. 10 is a vertical cross-sectional view illustrating a configuration of the sheet discharging device 50 according to the fifth illustrative embodiment. FIG. 11A is a vertical cross-sectional view illustrating the sheet discharging device 50 illustrated in FIG. 10 at the start of closing of the sheet discharge tray 8. FIG. 11B is a vertical cross-sectional view illustrating the sheet discharging device 50 illustrated in FIG. 10 in which the sheet discharge tray 8 is in the process of being closed. FIG. 11C is a vertical cross-sectional view illustrating the sheet discharging device 50 illustrated in FIG. 10 after the sheet discharge tray 8 is closed.

In the sheet discharging device 50 according to the fifth illustrative embodiment, the shutter 11 slides in a direction parallel to the surface of the sheet discharge tray 8 in conjunction with opening and closing of the sheet discharge tray 8. The sheet discharge tray 8 includes a guide member 29 serving as the driving mechanism to slide the shutter 11 in the direction parallel to the surface thereof, and a recessed portion 18 that accommodates the shutter 11 therewithin when the sheet discharge tray 8 is closed.

The shutter 11 is driven by an arm 22 provided between the shutter 11 and the main body of the image forming apparatus 100. One end 22*a* of the arm 22 is supported by the shutter 11, and another end 22*b* of the arm 22 is supported by a shaft of the discharging roller 9*a*. Accordingly, when the sheet discharge tray 8 is opened to the extended position, the arm 22 slides the shutter 11 in the direction parallel to the surface of the sheet discharge tray 8 to close the opening 14. An angle between the arm 22 and the shutter 11 is changed in conjunction with opening and closing of the sheet discharge tray 8. Accordingly, the shutter 11 slides into the recessed portion 18 provided within the sheet discharge tray 8 while the sheet discharge tray 8 is being closed as illustrated in FIGS. 11A and 11B. When the sheet discharge tray 8 is completely closed, slide movement of the shutter 11 is completed so that the opening 14 is opened as illustrated in FIG. 11C. The opening 14 can be opened even when the auxiliary tray 10 is stored within the sheet discharge tray 8.

As described above, the sheet discharging device 50 according to the foregoing illustrative embodiments includes the sheet discharge tray 8 having the opening 14 therein. Accordingly, the sheet P discharged from the image forming apparatus 100 can be reliably discharged from the opening 14 even when the sheet discharge tray 8 is closed. As a result, the image forming apparatus 100 requires less installation space. In addition, the shutter 11 provided in the sheet discharge tray 8 closes the opening 14 to form a flush interior surface of the sheet discharge tray 8 when the sheet discharge tray 8 is opened to the extended position, thereby preventing a paper jam at the opening 14. The shutter 11 swings out of the way to uncover the opening 14 when the sheet discharge tray 8 is closed, thereby allowing the sheet P to be reliably discharged from the image forming apparatus 100 through the opening 14.

The shutter 11 is rotatably provided at the opening 14. In a case in which the protrusions 12 of the shutter 11 are provided at the upper portion of the opening 14, the shutter 11 covers the opening 14 from the top thereof when the sheet discharge tray 8 is closed. This configuration prevents the user from touching an exit of the sheet P discharged from the image forming apparatus 100 where a number of components such as the pair of discharging rollers 9 are provided, achieving safety of the user. In addition, such a configuration hides the exit of the sheet P, enhancing design of the image forming apparatus 100.

The shutter 11 is constantly biased by the torsion springs 24 toward the direction of closing the shutter 11. Accordingly, the shutter 11 automatically closes the opening 14 when the sheet discharge tray 8 is opened, facilitating operation of the user.

The upper downstream edge 20 of the shutter 11 is higher than the upper downstream edge 14*a* of the opening 14 when the shutter 11 is closed. Accordingly, the sheet P discharged from the image forming apparatus 100 is prevented from getting stuck at a boundary between the shutter 11 and the opening 14, thereby reliably discharging the sheet P onto the sheet discharge tray 8.

The sheet discharging device 50 includes the protrusions 15 that contact the shutter 11 when the sheet discharge tray 8 is closed. Accordingly, the shutter 11 is pushed away and opened by the protrusions 15 to open the opening 14 when the sheet discharge tray 8 is closed. The shutter 11 is opened and closed in conjunction with opening and closing of the sheet discharge tray 8 as described above, thereby facilitating operation of the user.

The protrusions 15 may be formed together with components of the image forming apparatus 100 such as the holding guide for the pair of discharging rollers 9 as a single integrated unit, thereby reducing a number of components and costs. Further, provision of the multiple protrusions 15 can achieve smooth movement of the shutter 11.

The shutter 11 includes the convexities 21 at the portions contacting the protrusions 15. Accordingly, the shutter 11 contacts the protrusions 15 without contacting the pair of discharging rollers 9 when the sheet discharge tray 8 is closed, thereby preventing damage to the surfaces of the pair of discharging rollers 9.

The shutter 11 has a wider rotation range so that the sheet P colliding with the shutter 11 moves the shutter 11 further downstream in the direction of conveyance of the sheet P, thereby reducing impact on the sheet P.

The shutter 11 is provided with the driven roller 16 rotated by conveyance of the sheet P colliding with the shutter 11, thereby reducing impact on the sheet P.

The shutter 11 opens and closes the opening 14 of the sheet discharge tray 8 by sliding in the direction parallel to the surface of the sheet discharge tray 8. Accordingly, the shutter 11 does not protrude from the sheet discharge tray 8, thereby reducing the installation space compared with the configuration in which the shutter 11 is rotated to open and close the opening 14.

The shutter 11 opens and closes the opening 14 of the sheet discharge tray 8 by sliding in the direction parallel to the surface of the sheet discharge tray 8 in conjunction with opening and closing of the sheet discharge tray 8. As a result, operation of the user is facilitated, and the installation space for the image forming apparatus 100 is reduced. Further, the opening 14 can be closed by the shutter 11 without extending the auxiliary tray 10 from the sheet discharge tray 8 to reliably discharge the sheet P on the sheet discharge tray 8.

The pair of discharging rollers 9 is fitted into the opening 14 of the sheet discharge tray 8 when the sheet discharge tray 8 is closed. Accordingly, the image forming apparatus 100 can be made more compact by an amount equivalent to a size of the pair of discharging rollers 9 compared to the configuration of the related art in which the sheet discharge tray is provided outside the pair of discharging rollers.

The sheet discharging device 50 according to the foregoing illustrative embodiments is applicable to image forming apparatuses such as copiers, printers, facsimile machines, inkjet recording devices, and multifunction devices having two or more of copying, printing, facsimile, and inkjet-recording functions.

It is to be noted that illustrative embodiments of the present invention are not limited to those described above, and various modifications and improvements are possible without departing from the scope of the present invention. It is therefore to be understood that, within the scope of the associated claims, illustrative embodiments may be practiced otherwise than as specifically described herein. For example, elements and/or features of different illustrative embodiments may be combined with each other and/or substituted for each other within the scope of the illustrative embodiments.

What is claimed is:

1. A sheet discharging device, comprising:

a sheet discharging unit provided at one end of an image forming apparatus, the sheet discharging unit including a pair of discharging rollers to discharge sheets from the image forming apparatus;

a sheet discharge tray located adjacent to the sheet discharging unit, rotatably provided at the end of the image forming apparatus in a stored position to cover the end of the image forming apparatus such that a back surface of the sheet discharge tray is substantially flush with the end of the image forming apparatus, and in an extended position, the sheet discharge tray extends from the end of the image forming apparatus to stack the sheets discharged from the image forming apparatus, the sheet discharge tray including:

an opening through which the sheets are discharged from the image forming apparatus, the opening provided at a portion of the sheet discharge tray opposite the pair of discharging rollers; and a shutter disposed over the opening to open and close the opening; and a driving mechanism to drive the shutter in conjunction with rotary movement of the sheet discharge tray to open the opening in the sheet discharge tray in the stored position and to close the opening in the sheet discharge tray in the extended position.

2. The sheet discharging device according to claim 1, wherein the shutter is hinged along an edge of the opening.

3. The sheet discharging device according to claim 1, wherein:

the shutter comprises a biasing member to bias the shutter to close the opening; and the shutter contacts a part of the sheet discharge tray to determine a position of the shutter upon closing the opening.

4. The sheet discharging device according to claim 1, wherein a downstream edge of the shutter closing the opening in a direction of discharge of the sheets is higher than a downstream edge of the opening adjacent to the downstream edge of the shutter.

5. The sheet discharging device according to claim 1, wherein the driving mechanism comprises protrusions provided to at least one of the sheet discharging unit and the sheet discharge tray to drive the shutter to open the opening without the shutter contacting the pair of discharging rollers while the sheet discharge tray is being rotated to the stored position.

6. The sheet discharging device according to claim 1, wherein the shutter further comprises a driven roller on a surface thereof to guide the sheets discharged from the image forming apparatus.

7. The sheet discharging device according to claim 1, wherein:

the driving mechanism further comprises a guide member provided in the sheet discharge tray to slide the shutter in a direction parallel to a surface of the sheet discharge tray; and the shutter is guided by the guide member to open and close the opening.

8. The sheet discharging device according to claim 7, further comprising an arm member to slide the shutter in the direction parallel to the surface of the sheet discharge tray in conjunction with rotary movement of the sheet discharge tray, one end of the arm member connected to the sheet discharging unit, and another end of the arm member connected to the shutter.

9. The sheet discharging device according to claim 1, wherein the pair of discharging rollers is accommodated within the opening in the sheet discharge tray in the stored position.

10. A sheet discharging device, comprising:

sheet discharging means for discharging sheets from an image forming apparatus;

a sheet discharge tray located adjacent to the sheet discharging means, rotatably provided at one end of the image forming apparatus in a stored position to cover the end of the image forming apparatus, and in an extended position, the sheet discharge tray extends from the end of the image forming apparatus to stack the sheets discharged from the image forming apparatus, the sheet discharge tray including:

an opening through which the sheets are discharged from the image forming apparatus, the opening provided at a portion of the sheet discharge tray opposite the sheet discharging means; and a shutter disposed over the opening to open and close the opening; and driving means for driving the shutter in conjunction with rotary movement of the sheet discharge tray to open the opening in the sheet discharge tray in the stored position and to close the opening in the sheet discharge tray in the extended position.

11. An image forming apparatus, comprising:

a sheet discharging device; and an image forming unit to form images on sheets based on image data, the sheet discharging device including:

a sheet discharging unit provided at one end of the image forming apparatus, the sheet discharging unit including a pair of discharging rollers to discharge the sheets from the image forming apparatus;

a sheet discharge tray located adjacent to the sheet discharging unit, rotatably provided at the end of the image forming apparatus in a stored position to cover the end of the image forming apparatus, and in an extended position, the sheet discharge tray extends from the end of the image forming apparatus to stack the sheets discharged from the image forming apparatus, the sheet discharge tray including:

an opening through which the sheets are discharged from the image forming apparatus, the opening provided at a portion of the sheet discharge tray opposite the pair of discharging rollers; and a shutter disposed over the opening to open and close the opening; and a driving mechanism to drive the shutter in conjunction with rotary movement of the sheet discharge tray to open the opening in the sheet discharge tray in the stored position and to close the opening in the sheet discharge tray in the extended position.

12. A sheet discharging device, comprising:

a sheet discharging unit provided at one end of an image forming apparatus, the sheet discharging unit including a pair of discharging rollers to discharge sheets from the image forming apparatus;

a sheet discharge tray located adjacent to the sheet discharging unit, rotatably provided at the end of the image forming apparatus in a stored position to cover the end of the image forming apparatus, and in an extended position, the sheet discharge tray extends from the end of the image forming apparatus to stack the sheets discharged from the image forming apparatus, the sheet discharge tray including:

an opening through which the sheets are discharged from the image forming apparatus, the opening provided at a portion of the sheet discharge tray opposite the pair of discharging rollers, and the pair of discharging rollers is accommodated within the opening in the sheet discharge tray in the stored position; and a shutter disposed over the opening to open and close the opening; and a driving mechanism to drive the shutter in conjunction with rotary movement of the sheet discharge tray to open the opening in the sheet discharge tray in the stored position and to close the opening in the sheet discharge tray in the extended position.

13. The sheet discharging device according to claim 12, wherein the shutter is hinged along an edge of the opening.

14. The sheet discharging device according to claim 12, wherein:

the shutter comprises a biasing member to bias the shutter to close the opening; and the shutter contacts a part of the sheet discharge tray to determine a position of the shutter upon closing the opening.

15. The sheet discharging device according to claim 12, wherein a downstream edge of the shutter closing the opening in a direction of discharge of the sheets is higher than a downstream edge of the opening adjacent to the downstream edge of the shutter.

16. A sheet discharging device, comprising:

a sheet discharging unit provided at one end of an image forming apparatus, the sheet discharging unit including a pair of discharging rollers to discharge sheets from the image forming apparatus;

a sheet discharge tray located adjacent to the sheet discharging unit, rotatably provided at the end of the image forming apparatus in a stored position to cover the end of the image forming apparatus, and in an extended position, the sheet discharge tray extends from the end of the image forming apparatus to stack the sheets discharged from the image forming apparatus, the sheet discharge tray including:

an opening through which the sheets are discharged from the image forming apparatus, the opening provided at a portion of the sheet discharge tray opposite the pair of discharging rollers; and a shutter disposed over the opening to open and close the opening; and a driving mechanism to drive the shutter in conjunction with rotary movement of the sheet discharge tray to open the opening in the sheet discharge tray in the stored position and to close the opening in the sheet discharge tray in the extended position, wherein the driving mechanism further includes protrusions provided to at least one of the sheet discharging unit and the sheet discharge tray to drive the shutter to open the opening without the shutter contacting the pair of discharging rollers while the sheet discharge tray is being rotated to the stored position.

17. A sheet discharging device, comprising:

a sheet discharging unit provided at one end of an image forming apparatus, the sheet discharging unit including a pair of discharging rollers to discharge sheets from the image forming apparatus;

a sheet discharge tray located adjacent to the sheet discharging unit, rotatably provided at the end of the image forming apparatus in a stored position to cover the end of the image forming apparatus, and in an extended position, the sheet discharge tray extends from the end of the image forming apparatus to stack the sheets discharged from the image forming apparatus, the sheet discharge tray including:

an opening through which the sheets are discharged from the image forming apparatus, the opening provided at a portion of the sheet discharge tray opposite the pair of discharging rollers; and a shutter disposed over the opening to open and close the opening, the shutter further includes a driven roller on a surface thereof to guide the sheets discharged from the image forming apparatus; and a driving mechanism to drive the shutter in conjunction with rotary movement of the sheet discharge tray to open the opening in the sheet discharge tray in the stored position and to close the opening in the sheet discharge tray in the extended position.

18. A sheet discharging device, comprising:

a sheet discharging unit provided at one end of an image forming apparatus, the sheet discharging unit including a pair of discharging rollers to discharge sheets from the image forming apparatus;

a sheet discharge tray located adjacent to the sheet discharging unit, rotatably provided at the end of the image forming apparatus in a stored position to cover the end of the image forming apparatus, and in an extended position, the sheet discharge tray extends from the end of the image forming apparatus to stack the sheets discharged from the image forming apparatus, the sheet discharge tray including:

an opening through which the sheets are discharged from the image forming apparatus, the opening provided at a portion of the sheet discharge tray opposite the pair of discharging rollers; and a shutter disposed over the opening to open and close the opening; and a driving mechanism to drive the shutter in conjunction with rotary movement of the sheet discharge tray to open the opening in the sheet discharge tray in the stored position and to close the opening in the sheet discharge tray in the extended position, wherein the driving mechanism further includes a guide member provided in the sheet discharge tray to slide the shutter in a direction parallel to a surface of the sheet discharge tray, and the shutter is guided by the guide member to open and close the opening.

19. The sheet discharging device according to claim 18, further comprising an arm member to slide the shutter in the direction parallel to the surface of the sheet discharge tray in conjunction with rotary movement of the sheet discharge tray, one end of the arm member connected to the sheet discharging unit, and another end of the arm member connected to the shutter.

* * * * *